US009321145B2

(12) United States Patent
Wallendorf et al.

(10) Patent No.: US 9,321,145 B2
(45) Date of Patent: Apr. 26, 2016

(54) DEVICE FOR FINE MACHINING OF OPTICALLY EFFECTIVE SURFACES ON IN PARTICULAR SPECTACLE LENSES AND FLEXIBLE PRODUCTION CELL COMPRISING SUCH A DEVICE

(71) Applicant: Satisloh AG, Baar (CH)

(72) Inventors: Steffen Wallendorf, Wetzlar-Dutenhofen (DE); Holger Schäfer, Weilmünster (DE)

(73) Assignee: Satisloh AG, Baar (CH)

( * ) Notice: Subject to any disclaimer, the term of this patent is extended or adjusted under 35 U.S.C. 154(b) by 27 days.

(21) Appl. No.: 14/384,011

(22) PCT Filed: Jan. 29, 2013

(86) PCT No.: PCT/EP2013/000249

§ 371 (c)(1),
(2) Date: Sep. 9, 2014

(87) PCT Pub. No.: WO2013/135331

PCT Pub. Date: Sep. 19, 2013

(65) Prior Publication Data

US 2015/0038061 A1 Feb. 5, 2015

(30) Foreign Application Priority Data

Mar. 10, 2012 (DE) ..... 10 2012 004 547

(51) Int. Cl.
*B24B 47/22* (2006.01)
*B24B 13/00* (2006.01)
(Continued)

(52) U.S. Cl.
CPC ..... *B24B 47/22* (2013.01); *B24B 13/00* (2013.01); *B24B 13/0037* (2013.01); *B24B 27/0084* (2013.01); *B24B 41/005* (2013.01)

(58) Field of Classification Search
CPC B24B 13/00; B24B 13/0037; B24B 27/0084; B24B 41/005; B24B 47/22
See application file for complete search history.

(56) References Cited

U.S. PATENT DOCUMENTS 2,916,857 A 12/1959 Dargie
3,686,796 A 8/1972 Clark
(Continued)

FOREIGN PATENT DOCUMENTS

CN 201881150 U 6/2011

OTHER PUBLICATIONS

International Preliminary Report on Patentability, International Application No. PCT/EP2013/000249, International Filing Date—Jan. 29, 2013, 6 pages (English translation).
(Continued)

*Primary Examiner* — Lee D Wilson
*Assistant Examiner* — Marc Carlson
(74) *Attorney, Agent, or Firm* — Reising Ethington P.C.

(57) ABSTRACT

The invention relates to a polishing machine for spectacle lenses, including a least one workpiece spindle protruding into a workspace for a rotary drive of the spectacle lens about a workpiece rotational axis. At least one feed device lowers and raises a polishing tool relative to the spectacle lens. An oscillation drive unit moves the feed device back and forth in an oscillation direction, which during the polishing runs substantially transversely to the workpiece rotational axis. A swivel drive unit swivels the feed device about a swivel-adjusting axis which runs substantially perpendicular to the workpiece rotational axis and substantially normal to the oscillation direction. A swivel mechanism is provided to swivel the feed device, the oscillation drive unit and the swivel drive unit relative to the workpiece.

24 Claims, 14 Drawing Sheets

(51) Int. Cl.
*B24B 27/00* (2006.01)
*B24B 41/00* (2006.01)

(56) References Cited

U.S. PATENT DOCUMENTS 4,216,626 A * 8/1980 Starp ..... B24B 13/023 451/163
5,938,381 A 8/1999 Diehl et al.
7,153,184 B2 12/2006 Kuebler et al.
7,278,192 B2 * 10/2007 Schaefer ..... B23Q 1/015 29/27 C
7,396,275 B2 * 7/2008 Drain ..... B24B 41/04 451/11
7,591,710 B2 * 9/2009 Drain ..... B24B 55/02 451/11
7,597,033 B2 10/2009 Savoie et al.
7,739,778 B2 6/2010 Fiedler et al.
8,696,410 B2 * 4/2014 Schussler ..... B24B 13/00 310/80
2007/0293128 A1 * 12/2007 Schafer ..... B24B 13/0037 451/7
2011/0065361 A1 * 3/2011 Schussler ..... B24B 13/00 451/11
2013/0344778 A1 * 12/2013 Schafer ..... B24B 13/023 451/294
2015/0047479 A1 * 2/2015 Wallendorf ..... B24B 13/046 82/118

OTHER PUBLICATIONS

German Office Action, Application No. 10 2012 004 547.6, Mailing Date Jan. 10, 2013, 4 pages.
PCT International Search Report and Written Opinion, International Application No. PCT/EP2013/000249, Mailing Date Aug. 27, 2013, 9 pages.
Chinese Office Action dated Dec. 3, 2015; Application No. 2013800134724, Applicant: Satisloh AG, 10 pages.

* cited by examiner

DEVICE FOR FINE MACHINING OF OPTICALLY EFFECTIVE SURFACES ON IN PARTICULAR SPECTACLE LENSES AND FLEXIBLE PRODUCTION CELL COMPRISING SUCH A DEVICE

TECHNICAL FIELD

The present invention relates generally to a device for the finish-processing of optically effective surfaces. In particular, the invention relates to a device for finish-processing of the optically effective surfaces of spectacle lenses such as used in so-called "RX workshops", i.e. production facilities for producing individual spectacle lenses according to the prescription on a large scale. Moreover, the invention relates to a flexible production cell for the processing of spectacle lenses.

PRIOR ART

The processing of the optically effective surfaces of spectacle lenses by machining can be roughly divided into two processing phases, namely initially preliminary-processing of the optically effective surface for producing the macro-geometry according to prescription and then processing of the optically effective surface to a finished state in order to eliminate preliminary-processing tracks and to obtain the desired micro-geometry. Whereas preliminary-processing of the optically effective surface of spectacle lenses is carried out inter alia in dependence on the material of the spectacle lenses by grinding (in the case of mineral glass), milling and/or turning (in the case of synthetic materials, for example polycarbonate, CR 39, HI Index, etc.), the optically effective surfaces of spectacle lenses are for the finish-processing usually subjected to a fine-grinding, lapping and/or polishing process, via a correspondingly appropriate processing device.

Above all, manually loaded polishing machines in RX workshops are in that case usually constructed as "twin machines" so that advantageously the two spectacle lenses of an "RX job" (a spectacle lens prescription always includes a spectacle lens pair) can be finish-processed simultaneously. Such a "twin" polishing machine is known from, for example, document US-A-2007/0155287 which is incorporated herein by reference.

In this previously known polishing machine, two parallel arranged workpiece spindles, which are respectively rotationally driven about an axis of rotation, but otherwise are stationary, project from below into a working space, where two polishing tools are opposite thereto, so that one polishing tool is associated with one workpiece spindle and the other polishing tool is associated with the other workpiece spindle. Each polishing tool is mounted for free rotation by way of a spherical bearing on a piston rod, which projects from above into the working space, of a respectively associated piston-cylinder arrangement, which is disposed above the working space and by which the respective polishing tool can be individually lowered or raised with respect to the associated workpiece spindle. The two piston-cylinder arrangements are, moreover, movable in common forwardly and rearwardly with respect to a front side of the polishing machine in a direction perpendicular to the axes of rotation of the workpiece spindles by a linear drive and, in addition, are tiltable in common by a pivot drive about a pivot axis, which similarly extends perpendicular to the axes of rotation of the workpiece spindles, but parallel to the front side of the polishing machine. The angular position between the axes of rotation of the tools and workpieces can be preset by the pivot drive before the tools are lowered by the piston-cylinder arrangements onto the workpieces. During the actual polishing process the workpieces are rotationally driven, in which case the tools disposed in processing engagement with the workpieces are rotationally entrained by friction, while the linear drive ensures that the tools are alternately moved back and forth with respect to the front side of the polishing machine (oscillatory movement), wherein the tools, running on a relatively small path, travel back and forth over the workpieces (so-called "tangential kinematics"). Moreover, the linear drive serves the purpose of moving tools and workpieces apart to such an extent that a change is possible.

Although the previously known polishing machine also has a very narrow construction, in depth direction it requires, due to the lengthy horizontal travel paths of the piston-cylinder arrangements perpendicular to the axes of rotation of the workpiece spindles, a relatively large footprint area, which, for instance, conflicts with use in a flexible production cell for spectacle lens processing for smaller RX workshops. In addition, the accessibility of this polishing machine, particularly for exchange of the workpieces and tools and for cleaning the working space, is not optimal.

It is desired to have a device for finish-processing of the optically effective surfaces of, in particular, spectacle lenses, which needs a comparatively small footprint area, so that it can be integrated without problems as a module in a flexible production cell for spectacle lens processing, and which in addition is of more ergonomic design by comparison with the prior art, with respect to workpiece and tool change as well as maintenance and cleaning operations. It is also desired to have a flexible production cell, which is constructed as economically as possible, for the preliminary-processing and finish-processing of spectacle lenses.

SUMMARY OF THE INVENTION

According to one aspect of the invention, a device for finish-processing optically effective surfaces of, in particular, spectacle lenses as workpieces includes at least one workpiece spindle, which projects into working space and by way of which a workpiece to be processed is drivable to rotate about a workpiece axis of rotation. At least one feed device for a tool, by which the tool is movable towards the workpiece and away therefrom, and an oscillatory drive unit are provided, by which the feed device is reciprocatingly movable in a direction of oscillation extending transversely to the workpiece axis of rotation when processing takes place. A pivot drive unit pivots the feed device about a pivot adjusting axis extending substantially perpendicularly to the workpiece axis of rotation and substantially normal to the direction of oscillation. A pivot mechanism pivots the feed device, the oscillatory drive unit and the pivot drive unit relative to the workpiece spindle from a closed relative position to an open relative position with opening of the working space and conversely.

In other words, according to one aspect of the invention a principal part of the device, which includes the feed device, the oscillatory drive unit and the pivot drive unit and which is at the tool side, is pivotably movable with respect to a principal part of the device, which includes the workpiece spindle and is at the workpiece side. Conversely or, in an alternative, the principal part of the device at the workpiece side is pivotable with respect to the principal part of the device at the tool side towards and away from one another and conversely or, in a further alternative, the two principal parts of the device are pivotable towards and away from one another and conversely.

As a consequence thereof it is possible, in particular, to substantially shorten the travel paths of the oscillatory drive unit by comparison with the prior art outlined above without obstructing the workpiece change or tool change. The device according to one aspect of the invention is of significantly more compact construction and needs less footprint area. Workpiece change and tool change are, just like maintenance and cleaning operations at the device, also simplified by comparison with the prior art described in the introduction, since as a consequence of the pivoting motion in accordance with the invention under opening of the working space a significantly larger opening cross-section is freed, via which an operative and/or optionally automated grippers, cleaning tools or the like can enter or gain access into the device without problems. Moreover, the pivoting motion in accordance to the invention can advantageously be such that in that regard there is a degree of 'turning towards' of the respective pivoted principal part of the device with respect to the freed opening cross-section so that the tools or workpieces can be gripped not only from the sides, but also from the front and thus more securely. As a result, the device according to the invention not only has a relatively small requirement for space, but additionally also good accessibility to the working space and therefore ergonomically a highly appropriate design, which overall makes it particularly suitable for use in a flexible production cell.

It shall be additionally explained at this point that the kinematic design of the device can in principle be as for the prior art category, in particular with an oscillatory drive unit which during processing is capable of reciprocatingly moving the feed device in an axial direction substantially perpendicularly to the workpiece axis of rotation and, specifically, back and forth with respect to the operator position or the front side of the device. However, the oscillatory movement can equally also be carried out longitudinally of or substantially parallel to the front side of the device and/or be realized by a pivot movement instead of an axial movement. The use of the pivot mechanism according to the invention is independent thereof.

In principle, it is conceivable to provide a separate capability of pivoting motion of the feed device, oscillatory drive unit and/or pivot drive unit relative to the workpiece spindle—in a given case even about the different pivot axes—in order to open the working space. However, with respect to ease of operation and low mechanical outlay it is preferred if the pivot mechanism has a common pivot axis for the feed device, the oscillatory drive unit and the pivot drive unit, about which the feed device, the oscillatory drive unit and the pivot drive unit are pivotable away in common with respect to the workpiece spindle and conversely.

It is additionally preferred if the pivot axis lies behind the working space as seen from an operator position. Compared to a similarly possible arrangement in which the pivot axis lies to the right or left of the working space as seen from the operator position the present construction has the advantage that symmetrical two-handed unobstructed working is possible so that the device can be used equally well by right-handed and lefthanded persons.

With respect to a device design which is constructionally narrow and mechanically simple it is, moreover, preferred if the pivot axis of the pivot mechanism extends substantially parallel to the pivot adjusting axis of the pivot drive unit.

Advantageously, the pivot mechanism can comprise a pivot frame with a grip section via which the feed device, the oscillatory drive unit and the pivot drive unit can be manually pivoted away with respect to the workpiece spindle and conversely. This represents a simple and economic alternative to an equally possible fully automated or motor-assisted pivot movement, which would also require suitable safety precautions (protective systems, protective devices). In a preferred embodiment the pivot frame can additionally carry a hood for opening or closing the device. By comparison with an equally conceivable hood independent of the pivot mechanism this additionally simplifies operation of the device.

Moreover, the pivot mechanism can comprise at least one spring element which facilitates pivoting motion away of the feed device, the oscillatory drive unit and the pivot drive unit with respect to the workpiece spindle. The at least one spring element (for example, one or more gas compressions springs) can in that case be so designed that, for example, it substantially holds up the weight of the parts to be pivoted away, which ensures a high level of operating convenience and adequate working precautions.

In addition, a positioning and closing mechanism can be provided which during the processing holds the feed device, the oscillatory drive unit and the pivot drive unit in the closed position thereof and ensures a substantially perpendicular orientation of the linearly extending oscillation direction with respect to the workpiece axis of rotation. The positioning and closing mechanism can thus counteract processing forces arising during the processing, for example as a consequence of exertion of polishing pressure by the feed device and at the same time guarantee the desired relative position of the moved parts with respect to one another, which is particularly important in the case of the polishing process mentioned in the introduction with tangential kinematics with respect to securing reproducible polishing results. In that regard, the positioning and closing mechanism can advantageously include a pressure-medium cylinder, for example a pneumatic cylinder, for holding the feed device, the oscillatory drive unit and the pivot drive unit in the closed position thereof, although mechanically positive locking of the pivot mechanism could also be used. Moreover, it is preferred if the positioning and closing mechanism has at least one adjustable abutment, which optionally includes a shock absorber and by which the orientation of the direction of oscillation is adjustable with respect to the workpiece axis of rotation. By comparison with a fixed abutment, which is also possible in principle, an adjustable abutment has, in particular, the advantage that production tolerances can be more readily taken into account because simple compensation can be made. Through the optionally present shock absorber it is possible to avoid damage to the device in the case of excessively firm closing of the working space.

In a preferred embodiment the device additionally has a base body which bounds the working space and supports the workpiece spindle and to which are fastened two mounts carrying the pivot axis of the pivot mechanism, wherein the oscillatory drive unit comprises a guide block pivotably mounted on the pivot axis between the mounts. Advantageously, a component of the oscillatory drive unit is thus also used for the pivot mechanism.

Moreover, the oscillatory drive unit can include two guide rods, which are longitudinally displaceably supported in the guide block, a guide head and a guide plate, wherein the guide rods are connected together on one side of the guide block by way of the guide head, whereas on the other side of the guide block they are connected together by way of the guide plate, and wherein the guide head is displaceable relative to the guide block by a threaded drive. To that extent the oscillatory drive unit can advantageously be constructed with a linear rod guide, the slide of which as guide block is pivotably "fixed" to the pivot axis of the pivot mechanism, with a high level of functional integration in the guide block. In that regard, it is additionally preferred with respect to a further functional integration in the oscillatory drive unit and a low parts count if the pivot drive unit has a pivot yoke which carries the feed device and is pivotably supported on the guide head of the oscillatory drive unit. A stroke module by which the pivot yoke is pivotable about the pivot adjusting axis is arranged between the guide plate of the oscillatory drive unit and the pivot yoke.

In furtherance of the concept of the invention it is possible, for construction of a "twin" machine, to provide two workpiece spindles which project into the working space and which are drivable by way of a belt drive for rotation about the workpiece axis of rotation, which belt drive has a belt pulley rotatable by a rotary drive, a belt and a tensioning and return pulley for the belt, which is seated between the workpiece spindles and mounted on the rotary drive eccentrically with respect to the belt pulley so that the belt can also be tensioned by a pivoting motion of the rotary drive. These measures are also conducive to achieving a very compact constructional form, wherein in addition no additional components are necessary for tensioning the belt. Rather, the latter is possible by mere rotation or a pivoting motion of the rotary drive.

If the aforedescribed device is used as an individual machine, i.e. not in a machine compound, then it obviously has to have a device for man/machine communication and a suitable control, for example a PC-based CNC control, which controls the drive modules and axial drives thereof. According to a further aspect of the invention a flexible production cell for the preliminary-processing and finish-processing of spectacle lenses accordingly has: (1) a device for the preliminary-processing of the optically effective surfaces of the spectacle lenses by milling, turning and/or grinding, which has regulated or controlled drive axes for workpiece and/or tool, with respectively associated drive modules, and (2) a device for the finish-processing of the optically effective surfaces of the spectacle lenses by polishing. For example, the above described device has regulated or controlled drive axes for workpiece and/or tool, with respectively associated drive module, and is coupled at least electrically and optionally also mechanically as a module to the device for the preliminary-processing, with the further feature that only the device for the preliminary processing has equipment for man/machine communication and a CNC control, which controls the drive modules of both devices. The electrical connection between the CNC control and the drive modules can in that case be effected by individual wiring or by way of a bus system. The device for the finish-processing without equipment for man/machine communication and an individual CNC control can thus be constructed very economically and, particularly in smaller RX workshops, can be added—in a given case also subsequently—without great outlay as a module to the device for the preliminary-processing.

BRIEF DESCRIPTION OF THE DRAWINGS

The invention is explained in more detail in the following by way of a preferred embodiment with reference to the accompanying, partly simplified or schematic drawings, in which.

DETAILED DESCRIPTION OF THE EMBODIMENT

Figure 1:
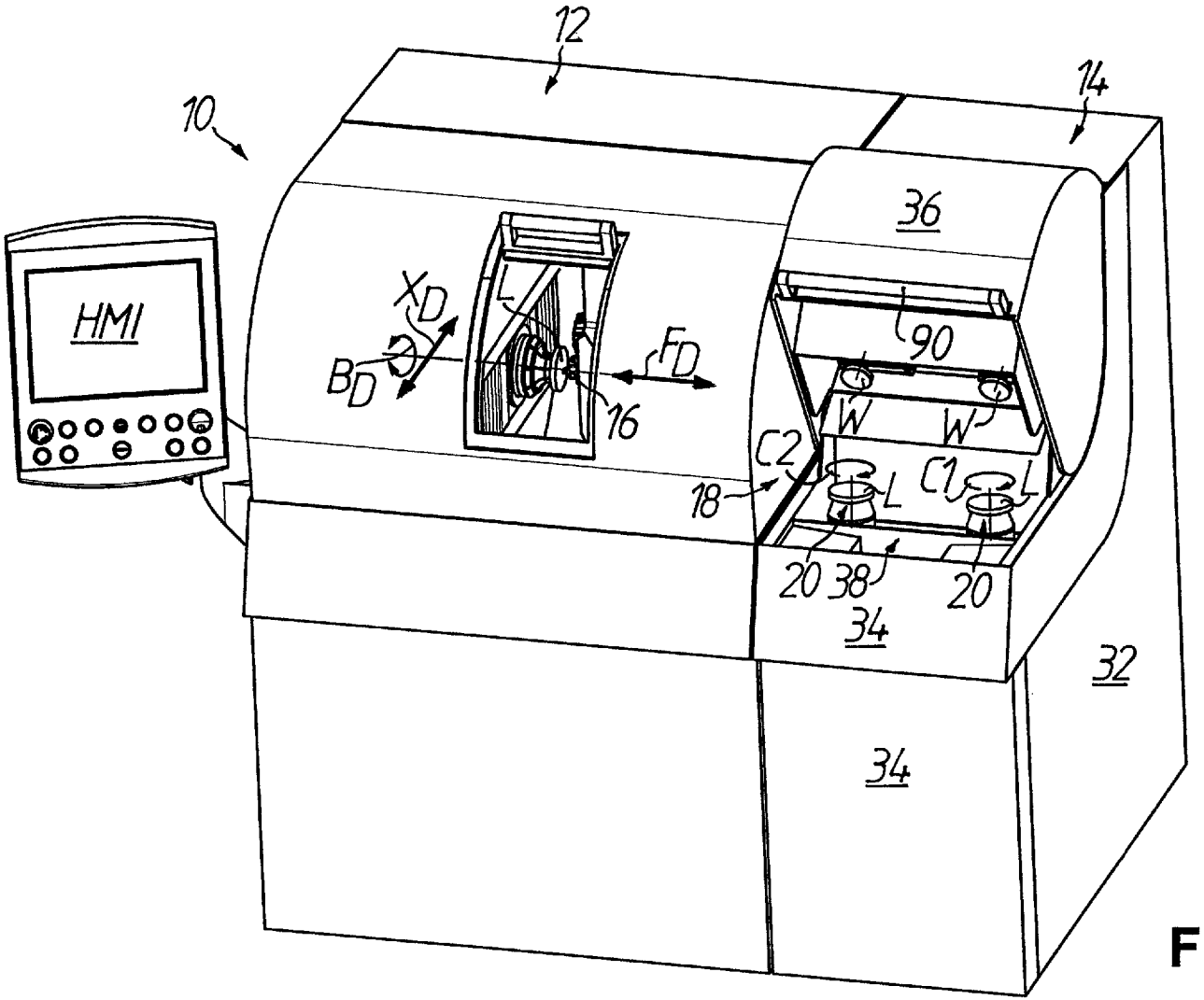
FIG. 1 shows a perspective view obliquely from above and front right of a flexible production cell for processing spectacle lenses, comprising—on the left—a device for preliminary-processing of spectacle lenses (also called generator) and—on the right—a device according to the invention docked therewith for consecutive finish-processing of the spectacle lenses (polishing machine), wherein to expose a view into the working space of the respective machine a pivot door of the generator and a hood of the polishing machine are pivoted up.
Figure 2:
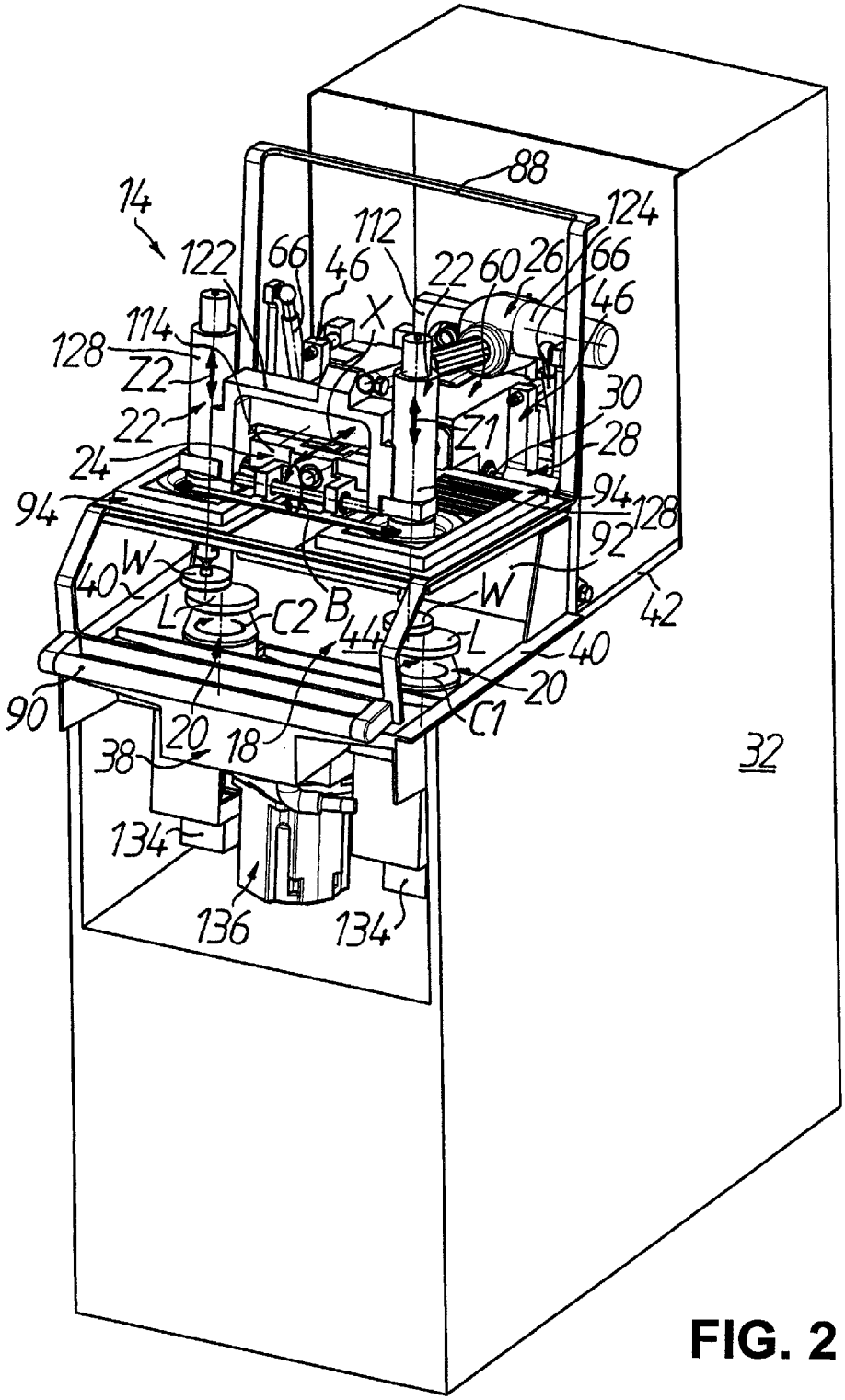
FIG. 2 shows a perspective view, which is enlarged in scale by comparison with FIG. 1, of the polishing machine according to FIG. 1 obliquely from above and the front right, which shows significant components or subassemblies of the machine, wherein for simplification of the illustration, in particular, the hood and further parts of the cover, the supply devices (including lines, hoses and pipes) for electrical power, compressed air and polishing medium, the polishing-medium return as well as measuring, maintenance and safety devices have been omitted.
Figure 3:
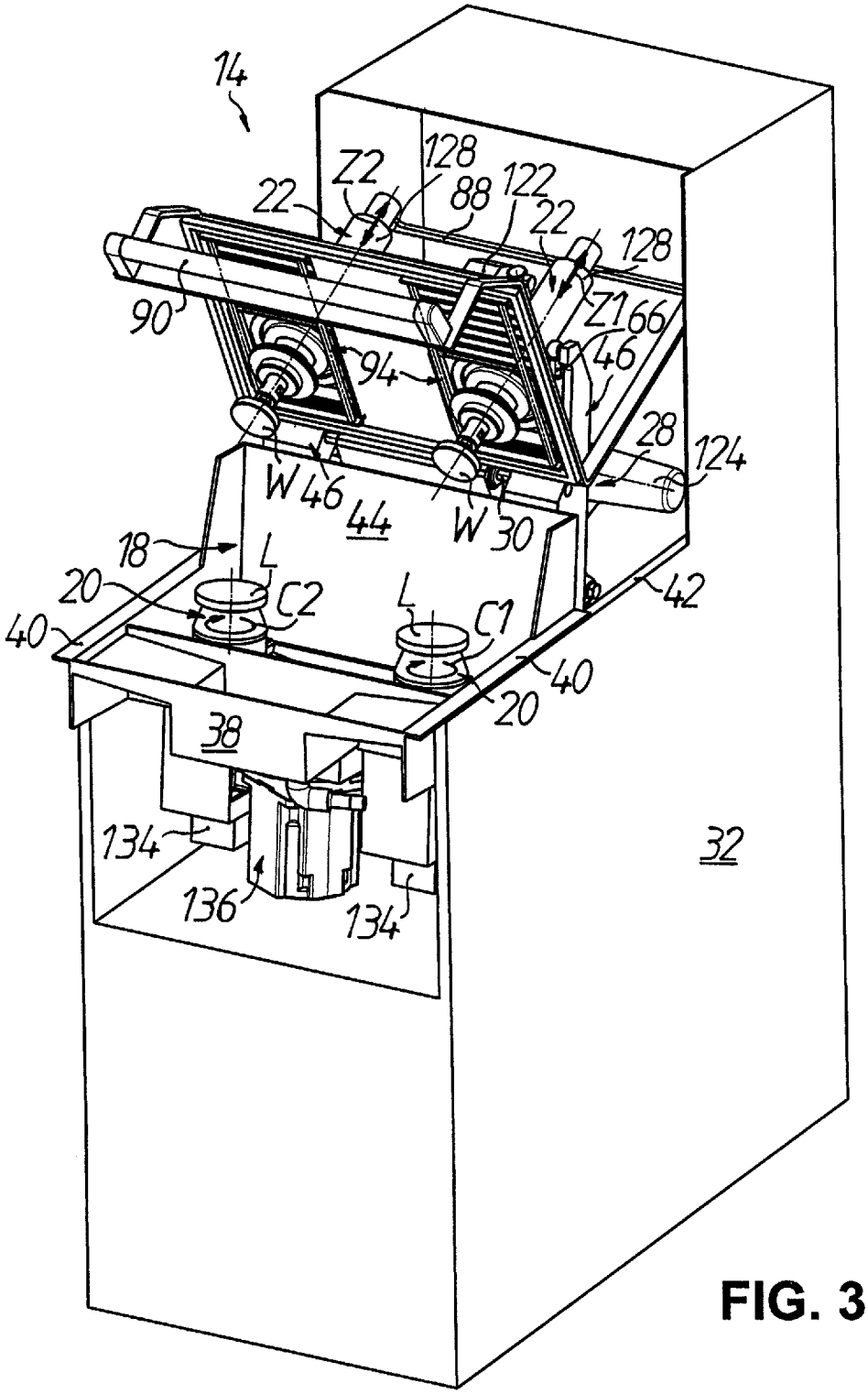
FIG. 3 shows a perspective view, which substantially corresponds with FIG. 2 in scale and viewing angle as well as with respect to simplifications of the illustration, of the polishing machine according to FIG. 1, in which an upper part of the machine is disposed in a position pivoted away from a lower part of the machine.
Figure 4:
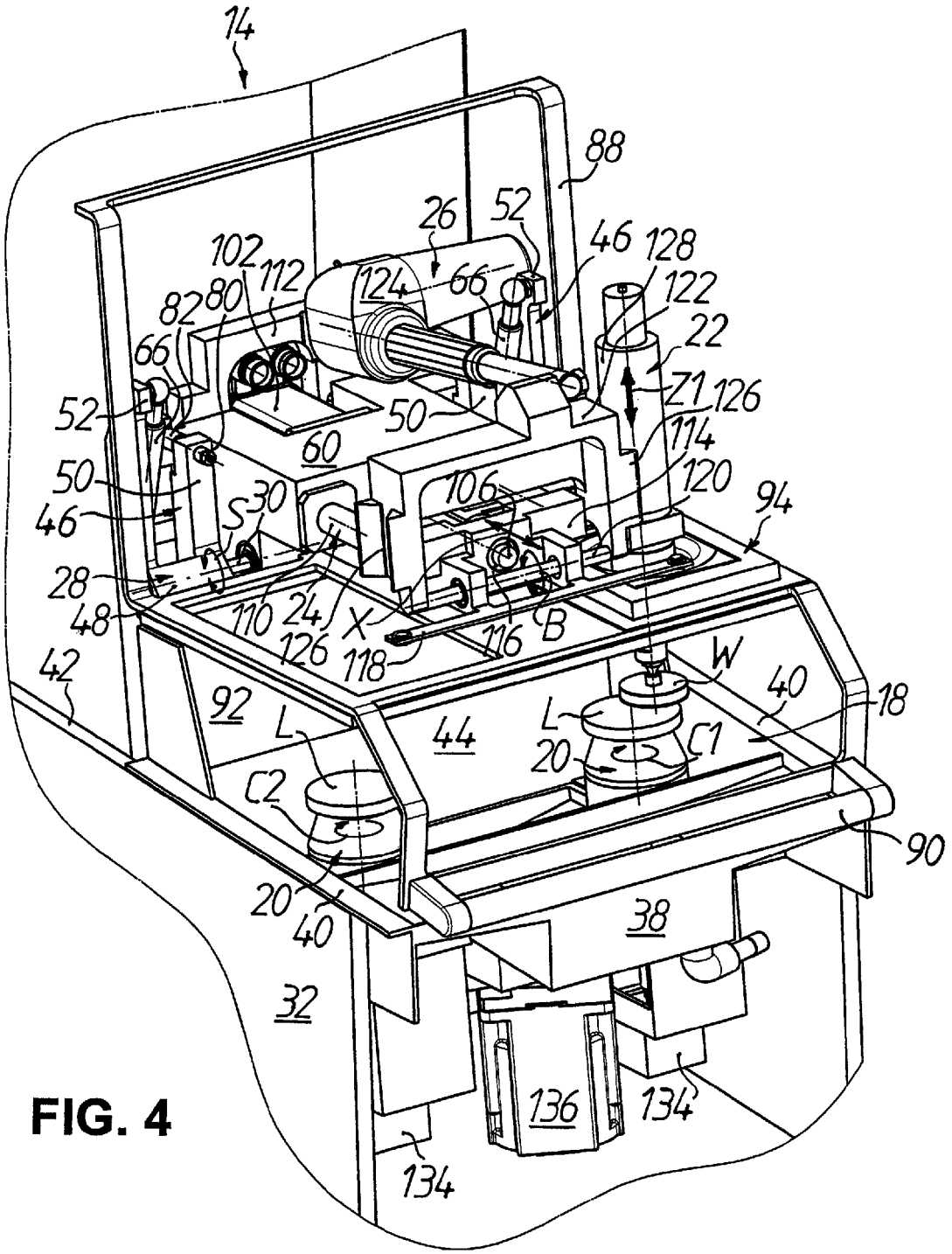
FIG. 4 shows a perspective view, which is broken away at the machine housing, of the polishing machine according to FIG. 1 obliquely from above and the front left in a scale enlarged by comparison with FIGS. 2 and 3, wherein a tool cylinder on the left in FIGS. 2 and 3 and an associated flexible working space cover have been omitted, in particular so as to expose a view onto the pivot axis, which is disposed therebehind, for the upper part of the machine.
Figure 5:
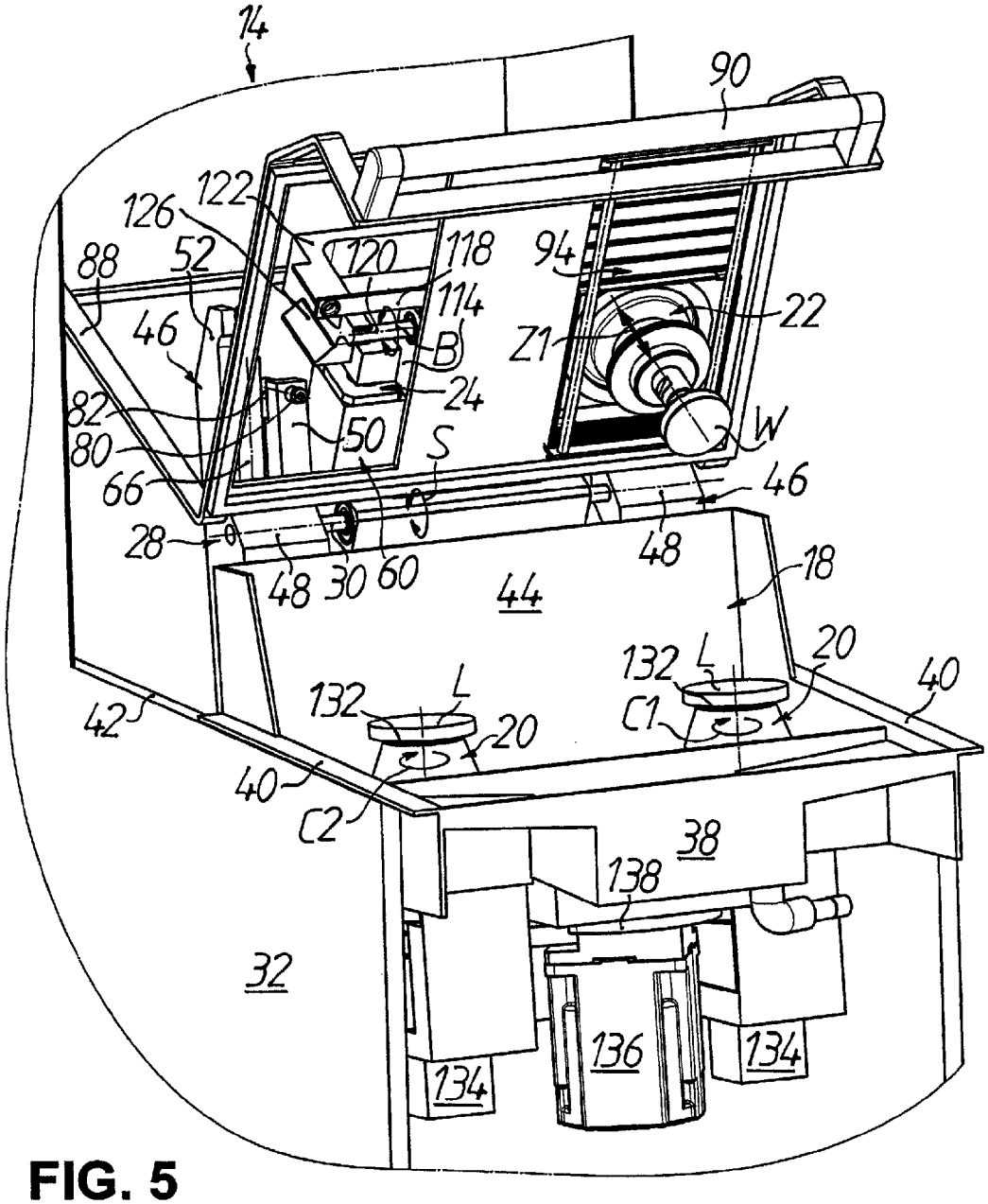
FIG. 5 shows a perspective view, which substantially corresponds with FIG. 4 in scale and viewing angle as well as with respect to simplifications of the illustration, of the polishing machine according to FIG. 1, in which the upper part of the machine is disposed in a position pivoted away from the lower part of the machine.
Figure 6:
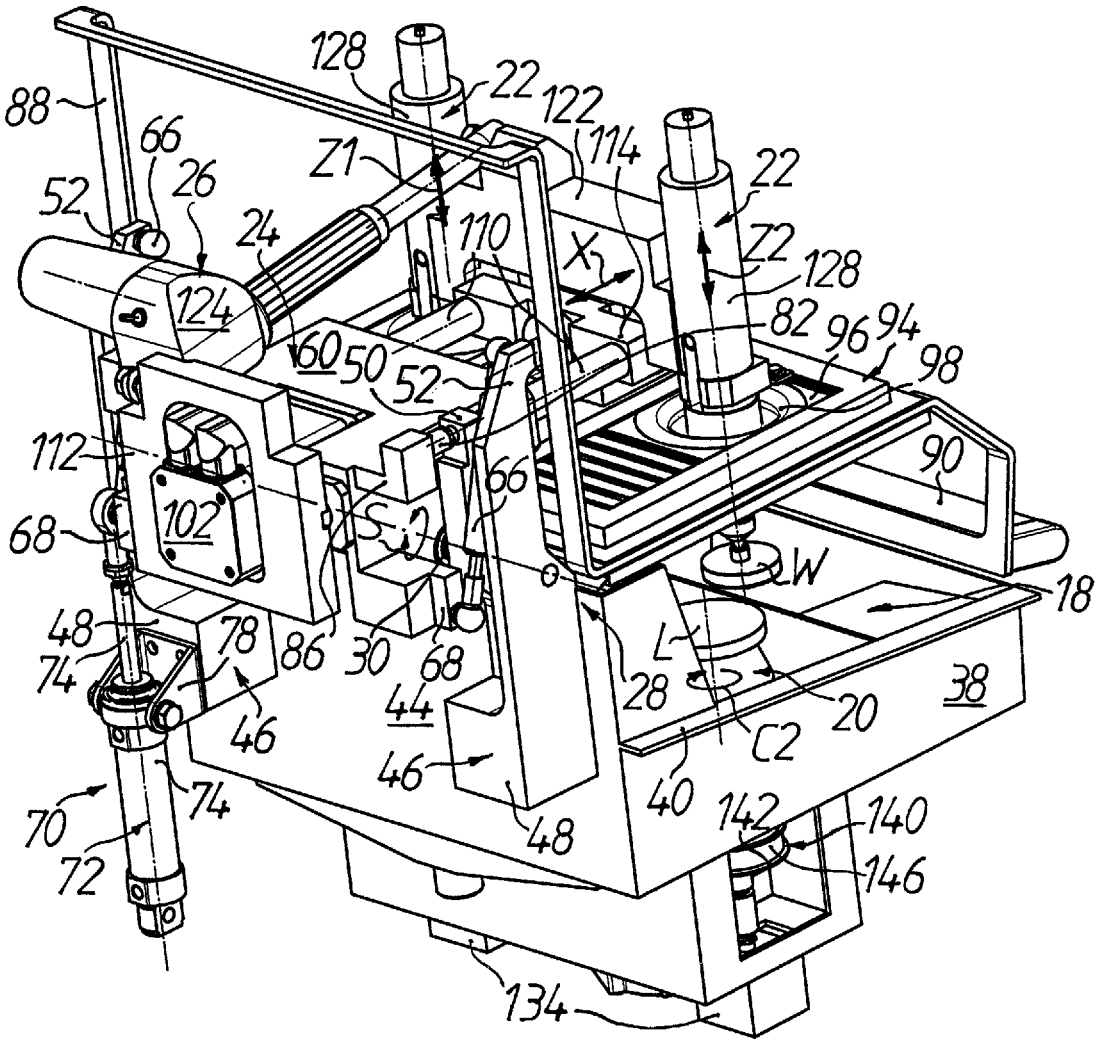
FIG. 6 shows a perspective view of the polishing machine according to FIG. 1 in the scale of FIGS. 4 and 5 obliquely from above and rear right, wherein by comparison with the illustration in FIGS. 2 and 3 the machine housing has been omitted.
Figure 7:
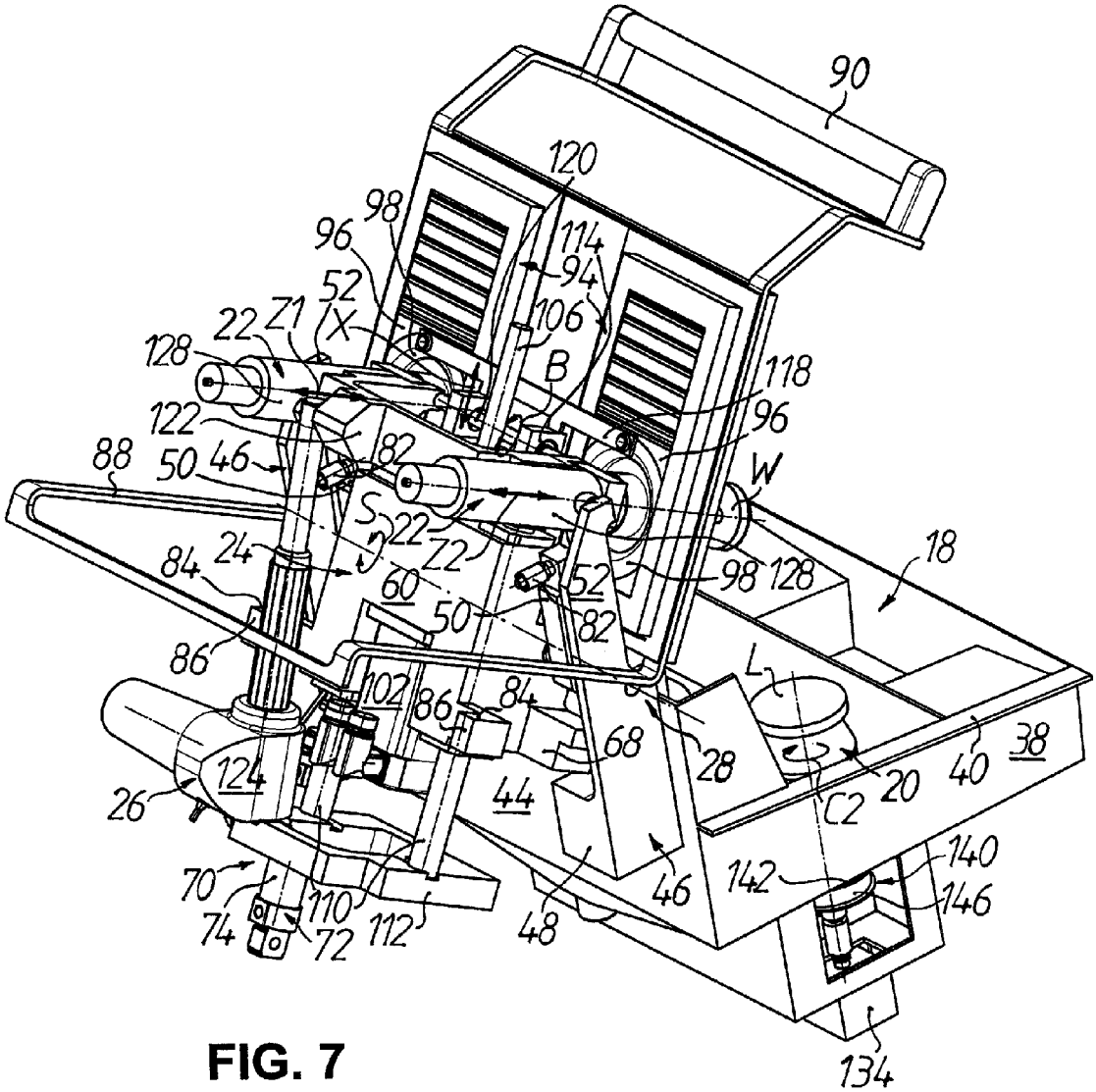
FIG. 7 shows a perspective view, which substantially corresponds with FIG. 6 in scale and viewing angle as well as with respect to simplifications of the illustration, of the polishing machine according to FIG. 1, in which the upper part of the machine is disposed in a position pivoted away from the lower part of the machine.
Figure 8:
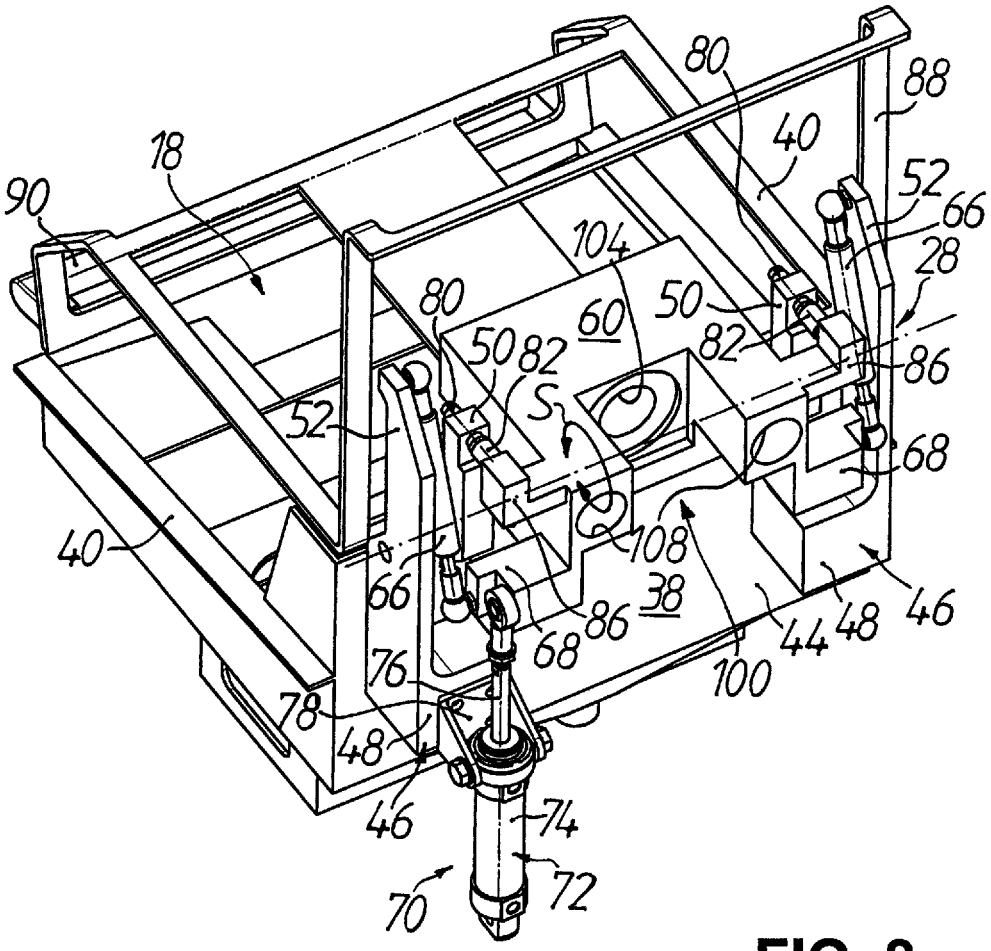
FIG. 8 shows a perspective view of the polishing machine according to FIG. 1 in the scale of FIGS. 6 and 7 obliquely from above and rear left, wherein by comparison with the illustration in FIGS. 6 and 7 all drive mechanisms and associated parts for workpieces and tools have been omitted (as far as a guide block of the oscillatory drive unit) so that the pivot mechanism for the upper part of the machine can be better seen.
Figure 9:
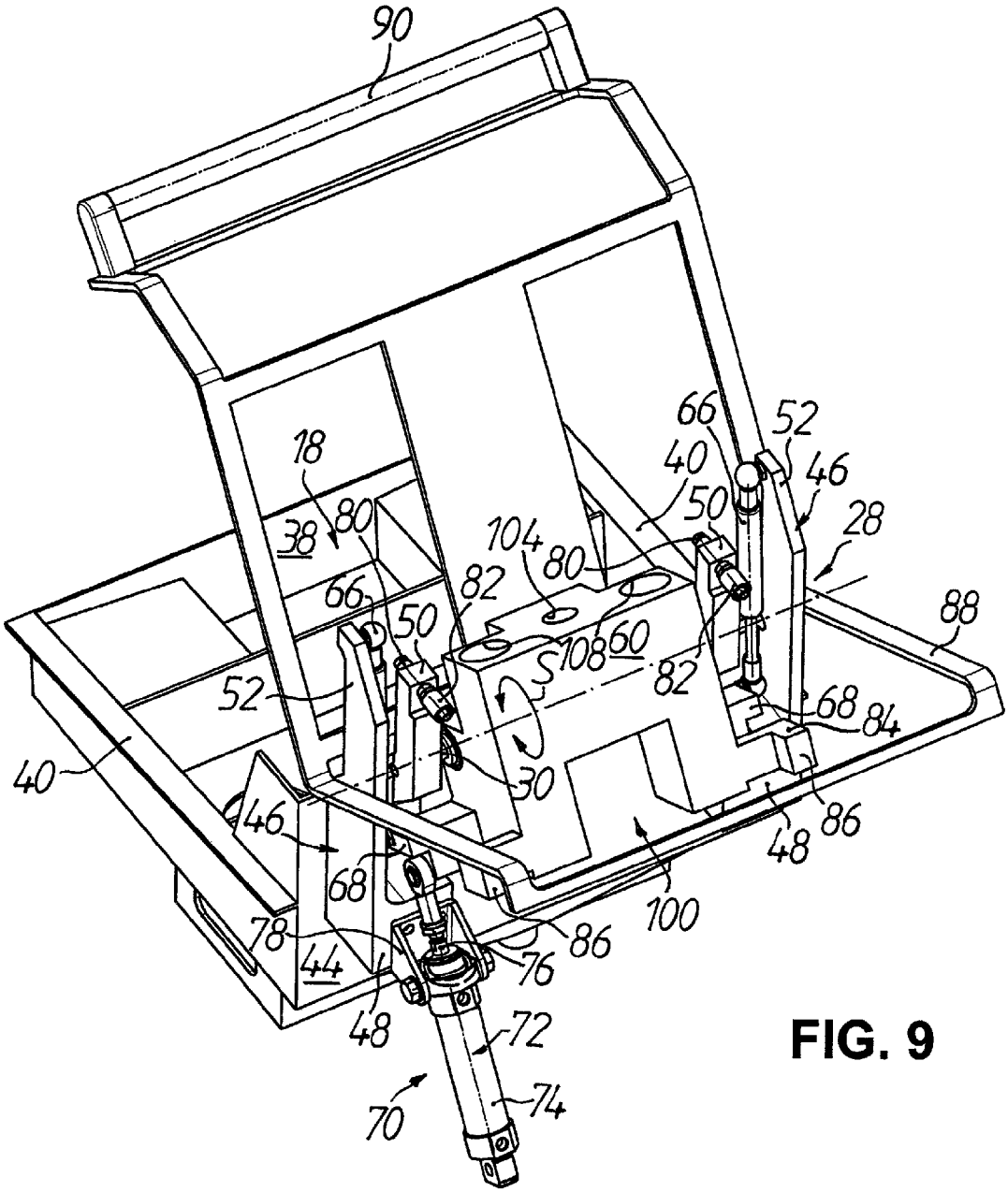
FIG. 9 shows a perspective view, which substantially corresponds with FIG. 8 in scale and viewing angle as well as with respect to simplifications of the illustration, of the polishing machine according to FIG. 1, in which the upper part of the machine is disposed in a position pivoted away from the lower part of the machine.

A flexible production cell for the preliminary-processing and finish-processing of spectacle lenses L in RX workshops is denoted generally by 10 in FIG. 1. In the illustrated embodiment the flexible production cell 10 has a device for preliminary-processing optically effective surfaces cc, cx (cf. FIGS. 10 and 11) of the spectacle lenses L, also called generator 12, as well as a device for processing the optically effective surfaces cc, cx of the spectacle lenses L to a finished state in the form of a polishing machine 14, which is mechanically and electrically docked as a module to the generator 12, as later described in more detail. In the following, there shall be explained primarily the construction and functioning of the polishing machine 14 which in the illustrated embodiment is realized in "twin" mode of construction so that two spectacle lenses L can be polished simultaneously.

With regard to the generator 12 it may merely be mentioned at this point that this can be constructed as a pure fast-tool turning machine or a combined milling/turning machine as known in principle from, for example, U.S. Pat. Nos. 7,278,192 B2 and 7,597,033 B2, which are hereby incorporated by reference. In these machines, optionally after preliminary-processing of the spectacle lenses L by milling as described in, for example, U.S. Pat. No. 5,938,381 A, which is hereby incorporated by reference, a lathe tool 16 is moved by a fast-tool servo either with linear reciprocation (oscillation axis $F_D$) or highly dynamically in rotation in order to generate at the lathe tool 16 a feed movement for the processing of spectacle lens surfaces which are not rotationally symmetrical, whilst the spectacle lens L is rotationally driven with generation of a cutting force (tool axis $B_D$ of rotation) and at the same time a relative movement between lathe tool 16 and spectacle lens L transversely to the oscillation axis $F_D$ takes place (linear axis $X_D$) in order to produce an advance from the spectacle lens edge to the spectacle lens center or conversely.

According to, in particular, FIGS. 2 to 7, 10 and 11 the polishing machine 14 has in general (i) two workpiece spindles 20, which project from below into a working space 18 and by way of which the spectacle lenses L to be processed can be driven to rotate about workpiece axes C1, C2 of rotation, (ii) two feed devices 22 each for a respective tool W, by which the respective tool W can be moved from above onto the associated spectacle lens L and away therefrom (linear movements Z1, Z2), (iii) an oscillatory drive unit 24, by which the feed devices 22 can be moved reciprocatingly in an oscillation direction (linear oscillation axis X), i.e. in the present case forwardly and backwardly with respect to a front side of the polishing machine 14, wherein the oscillation axis X during processing extends substantially transversely to the workpiece axes C1, C2 of rotation, and (iv) a pivot drive unit 26, by way of which the feed devices 22 can be pivoted about a pivot adjusting axis B extending substantially perpendicularly to the workpiece axes C1, C2 of rotation and substantially normal to the oscillation axis X.

As will be described in more detail in the following, the polishing machine 14 additionally has a pivot mechanism 28, by which the feed devices 22, the oscillatory drive unit 24 and the pivot drive unit 26 can be pivoted relative to the workpiece spindles 20 from a closed relative position (FIGS. 2, 4, 6, 8, 10 and 12 to 14), with opening of the working space 18, away to an open relative position (FIGS. 1, 3, 5, 7, 9 and 11) and conversely, namely in correspondence with the arrow S (pivot movement) in FIGS. 4 to 9, 13 and 14). In that case, in the illustrated embodiment the pivot movement S for the feed devices 22, the oscillatory drive unit 24 and the pivot drive unit 26 takes place in common and, in particular, about a common pivot axis 30 (see, especially, FIG. 14) of the pivot mechanism 28, which as seen from an operator position lies behind the working space 18 and extends substantially parallel to the pivot adjusting axis B.

According to FIGS. 1 to 5 the polishing machine 14 has a machine frame 32, which is assembled as a welded construction from sheet metal and which at the same time forms a part of a machine housing in which, apart from the drive units and mechanisms visible here, also the supply devices, control components, etc., (not shown) are received. In FIG. 1 the machine housing is completed upwardly and to the front by cover parts 34 as well as a hood 36, which is made at least partly of "Plexiglas" (PMMA) and is transparent and can similarly be pivoted by the pivot mechanism 28 relative to the machine frame 32. Inserted into the machine housing is a base body 38 which is similarly joined together as a welded construction from sheet metal and which bounds the working space 18 in a downward direction in the figures and there supports the workpiece spindles 20. The base body 38 has laterally angled flange sections 40 which are placed on associated bearing surfaces 42 of the machine frame 32 and screw-connected therewith (not illustrated) so as to secure the base body 38 in the polishing machine 14. As FIG. 1 shows, the machine housing of the polishing machine 14 is adapted with respect to its shape to the machine housing of the generator 12 so that the flexible production cell 10 overall has an external appearance "as if a single casting". In that case, the machine frame 32 of the polishing machine 14 is mechanically screw-connected with the machine frame of the generator 12 (not illustrated).

Further details of the pivot mechanism 28 can be seen clearly in FIGS. 8, 9, 13 and 14. Accordingly, two mounts 46 are fastened from behind to a rear wall 44 of the base body 38 at the same vertical height, but with a horizontal spacing from one another. Each mount 46 has a mount base 48, by which the respective mount 46 is fixedly screw-connected with the base body 38 (not illustrated), and two mounting arms, which extend upwardly away from the mounting base 48, in mirror-symmetrical arrangement from mount to mount, namely a shorter—referred to the intermediate space between the mounts 46—"inner" mounting arm 50 and a longer "outer" mounting arm 52.

Figure 14:
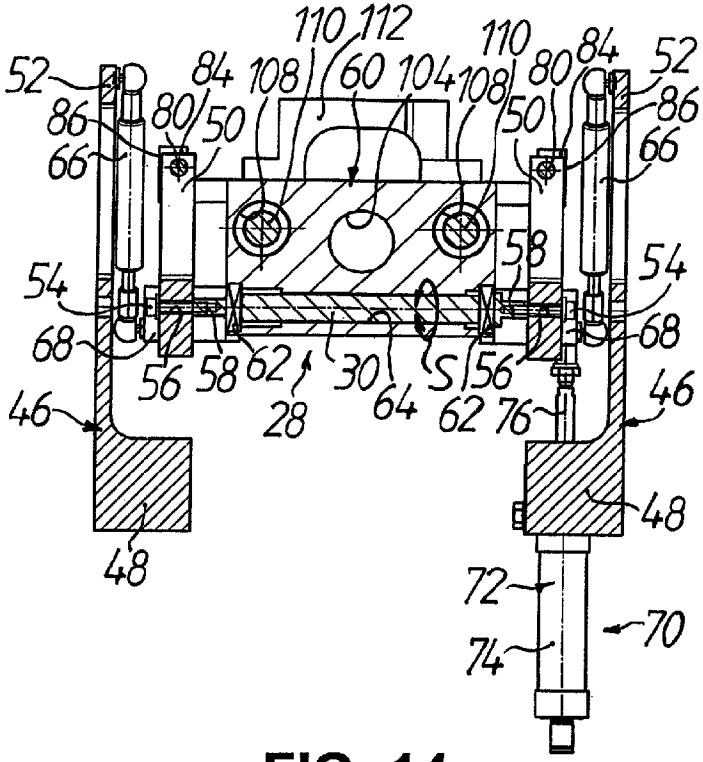
FIG. 14 shows a sectional view of the polishing machine according to FIG. 1 in correspondence with the section line XIV-XIV in FIG. 13, i.e. with a sectional plane through the pivot axis for the upper part of the machine.
Figure 13:
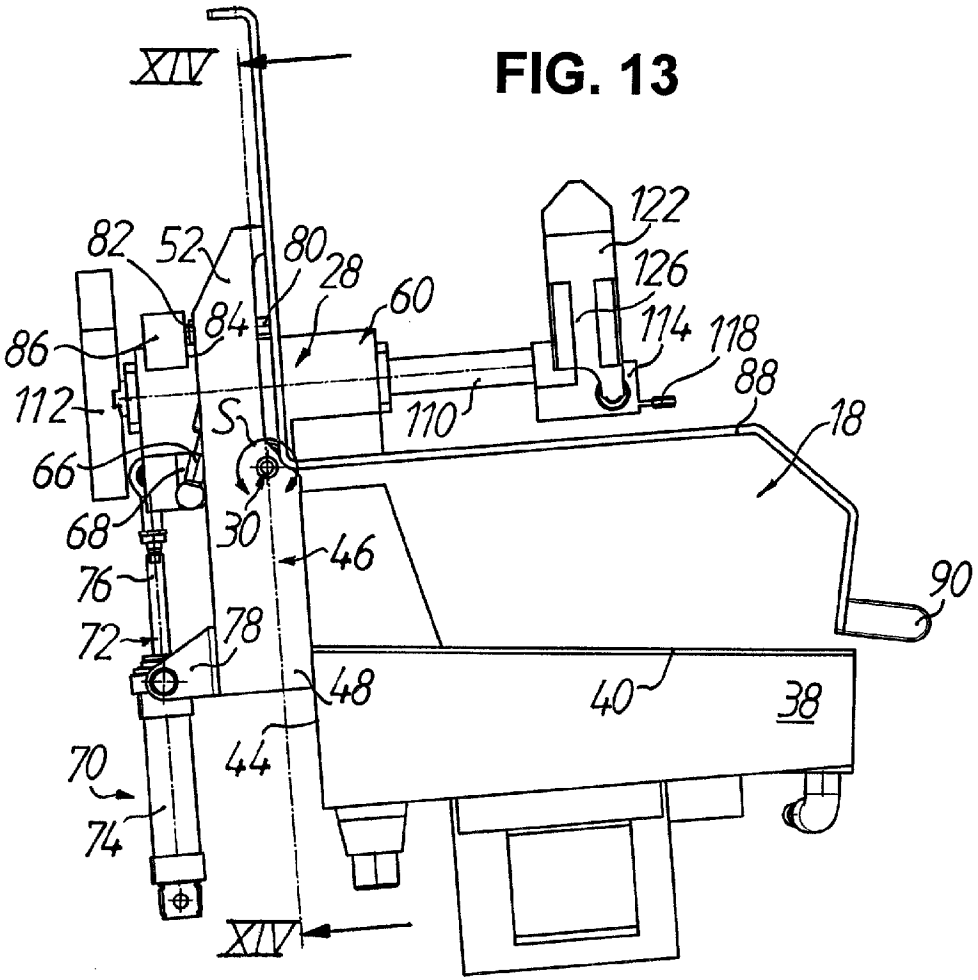
FIG. 13 shows a side view of the polishing machine according to FIG. 1 from the left in FIG. 10, wherein—similarly to FIGS. 8 and 9 and by comparison with the illustration in FIGS. 6 and 7—of the drive mechanism and associated parts for workpieces and tools in the upper part of the machine merely a pivot yoke of the pivot drive unit and the guide block of the oscillatory drive unit with guide head, guide rod and guide plate are shown.

These mounts 46 in the first instance support the pivot axis 30, as can be seen in FIGS. 13 and 14. More precisely, in accordance with FIG. 14 two screws 54 are provided, each of which engages through a passage bore 56, which is formed in the respective inner mounting arm 50 near the mount base 48, and is screwed into an associated threaded bore 58, which is formed at the front side, of the pivot axle 30, in order to fix the pivot axle 30 between the mounts 46. A guide block 60 of the oscillatory drive unit is pivotably mounted on the pivot axle 30 between the mounts 46 by way of two bearing elements 62, which are mounted in a stepped passage bore 64, which passes through the pivot axle 30, in the guide block 60.

Moreover, the pivot mechanism 28 in the illustrated embodiment has two spring elements, for example, gas compression springs 66, which facilitate pivot movement of the upper principal part, which has the feed devices 22, the oscillatory drive unit 24 and the pivot drive unit 26 and is at the tool side, of the polishing machine 14 with respect to the workpiece spindles 20. For that purpose, the gas compression springs 66 are each articulated at one end to the free end of the outer mounting arm 52 of the respectively associated mount 46 as can be best seen in FIGS. 8 to 10 and 14. The other end of the respective gas compression spring 66 is articulated to a respectively associated lower projection 68 of the guide block 60 of the oscillatory drive unit 24. The spring force of the gas compression springs 66 and the articulation points thereof determining the lever arm about the pivot axis 30 are in that case selected so that the torque produced by the weight of the pivoted components or subassemblies about the pivot axis 30 is largely counteracted.

Moreover, associated with the pivot mechanism 28 is a positioning and closing mechanism 70 which during processing keeps the upper principal part, which is at the tool side, with the feed devices 22, the oscillatory drive unit 24 and the pivot drive unit 26 in the closed position and ensures a substantially vertical orientation of the oscillation axis X with respect to the workpiece axes C1, C2 of rotation. The positioning and closing mechanism 70 in the first instance includes a pressure-medium cylinder, more precisely a pneumatic cylinder 72, for holding the components, which are pivotable about the pivot axis 30, in the closed position thereof, the cylinder including a cylinder housing 74 and a piston rod 76 connected with a piston of the pneumatic cylinder 72 and extending out of the cylinder housing 74. The cylinder housing 74 of the pneumatic cylinder 72 is pivotably connected with the bracket 78, which in turn is fastened on the mount base 48 of the mount 46 on the left in FIGS. 6 to 9 and, in particular, by way of screws (not illustrated here). The piston rod 76 of the pneumatic cylinder 72 on the other hand is pivotably connected with the lower projection 68, which is on the left in FIGS. 8 and 9, of the guide block 60. It is apparent from FIGS. 8 and 13 that in the case of pressure loading of the pneumatic cylinder 72, as a consequence of which the piston rod 76 strives to move out of the cylinder housing 74, in the closed position of the components or subassemblies pivotable by way of the pivot mechanism 38, a torque is generated about the pivot axis 30 (in clockwise sense in FIG. 13) which urges the components or subassemblies in the direction of the workpiece spindles 20.

In the illustrated embodiment the positioning and closing mechanism 70 additionally includes two length-adjustable abutments 80. Each abutment 80 has a shock absorber 82 (in the simplest form, for example, a rubber buffer) and serves the purpose of adjusting the orientation of the oscillation axis X with respect to the workpiece axes C1, C2 of rotation in the closed position, for which purpose they can have, for example, a thread which co-operates with a mating thread (not shown). As can be best seen in FIGS. 8 and 9, the adjustable abutments 80 with the respective shock absorber 82 are mounted at the free ends of the inner mounting arms 50 of the mounts 46 and, in particular, in such a manner that each shock absorber 82 in the closed position can come into contact with an associated abutment surface 84, which is formed at a further, lateral upper projection 86 of the guide block 60. To that extent the guide block 60 is formed by its lower projections 68 and its upper projections 86 to be in mirror symmetry with respect to a center axis. In that case, the projections 68, 86 can be formed integrally with the rest of the guide block 60 or fastened thereto in a suitable manner.

According to, in particular, FIGS. 2 to 11 and 13 the pivot mechanism 28 additionally has a pivot frame 88, which can be a multiply bent and upwardly angled sheet-metal part. The pivot frame 88 is fastened from below to the guide block 60 of the oscillatory drive unit 24 in a mode and manner which is not shown. A grip section 90 is mounted on the pivot frame 88 in a region at the front in FIGS. 2 to 5, via which grip section 90 by virtue of the fixed connection of the pivot frame 88 with the guide block 60 the oscillatory drive unit 24 and the components and subassemblies carried by that, particularly the pivot drive unit 26 and feed devices 22, can be manually pivoted away about the pivot axis 30 with respect to the workpiece spindles 20 and conversely. Apart from some covers and seals, of which there are illustrated in the figures in part a rubber skirt 92 as spray protection in the region of the pivot axis 30 and two bellows covers 94 with sheet-metal slider 96 and rubber sleeve 98 (see FIGS. 6, 7 and 11) for passage of the feed devices 22 with sealing relative to the working space 18, the pivot frame 88 also carries the hood 36, which is shown in FIG. 1, for opening and closing the polishing machine 14.

Further details of the oscillatory drive unit 24 can be seen in FIGS. 6 to 9, 13 and 14. Accordingly, the guide block 60 has a central cut-out 100, which is at the rear relative to the front side of the polishing machine 14, for receiving and fastening a servomotor 102 at the guide block 60. Starting from the cut-out 100 a central, stepped passage bore 104 extends through the guide block 60, through which bore a threaded spindle 106, which is rotationally drivable by the servomotor 102, of a ball screw is mounted to extend. The guide block 60 additionally has on either side of the passage bore 104 a respective continuous bearing bore 108, which runs parallel to the passage bore 104 and serves for receiving a spherical liner pair (not shown in more detail). In the guide bores 108 two guide rods 110 are mounted in the guide block 60 by way of the spherical liner pair to be longitudinally displaceable. On the motor side (servomotor 102) of the guide block 60 the guide rods 110 are connected together at the ends by way of a guide plate 112, which has a central cut-out for passage of the servomotor 102 (cf. FIGS. 4 and 6), whereas the guide rods 110 are connected together at the ends on the other side of the guide block 60 by way of a guide head 114. According to FIGS. 4 and 10 a nut 116, with which the threaded spindle 106 is in engagement, of the ball screw is fastened in the guide head 114. To that extent it is apparent that the guide head 114 with the guide rods 110 and the guide plate 112 is axially displaceable relative to the guide block 60 by way of the ball screw 106, 116 driven by the servomotor 102.

An entrainer 118 for the sheet-metal slider 96 of the bellows covers 94 is attached to the guide head 114. In addition, rotatably mounted on the guide head 114 is a pivot shaft 120 to which a pivot yoke 122 of the pivot drive unit 26 is fastened. The pivot drive unit 26 further has a stroke module 124 which is described in more detail in U.S. Pat. No. 8,696,410 B2 which is incorporated herein by reference for the avoidance of repetition with respect to construction and functioning of the stroke module 124. The stroke module 124 is pivotably connected by one end thereof with the guide plate 112 of the oscillatory drive unit 24, whereas it is pivotably connected by its other end with the pivot yoke 122 at a spacing from the pivot shaft 120. As a result, the pivot yoke 122 pivotably supported on the guide head 114 of the oscillatory drive unit 24 can be pivoted in a defined manner about the pivot shaft 120 (pivot adjusting axis B) by actuation of the stroke module 124, in which the length thereof changes.

The pivot yoke 122 of the pivot drive unit 26 additionally carries the feed devices 22. More precisely, the substantially U-shaped pivot yoke 122 according to, in particular, FIGS. 4, 5 and 13 has on both sides of its limbs receiving sections 126 at which the feed devices 22 are fastened so that the feed devices 22 can be pivoted in common about the pivot shaft 120 by the pivot yoke 122 (pivot adjusting axis B). In the illustrated embodiment the feed devices 22 comprise double-acting pneumatic tool cylinders 128—often also termed "Pinolen" (spindle sleeves)—which are known per se and to that extent do not need more detailed description. In the case of these tool cylinders 128 the polishing tools W, which are similarly known per se, are mounted to be free-running and pivotable at the free ends of the piston rods thereof. Through appropriate pressure loading of the tool cylinder 128 the polishing tool W can thus be lifted off the spectacle lens L or lowered onto the spectacle lens L and pressed thereagainst (linear movements Z1, Z2), in which case the polishing tool W is rotationally entrained by the spectacle lens L. However, a different form of the feed devices—optionally also with a rotary drive for the polishing tool, as described in U.S. Pat. No. 8,696,410 B2 is equally conceivable and which is hereby incorporated by reference.

Figure 10:
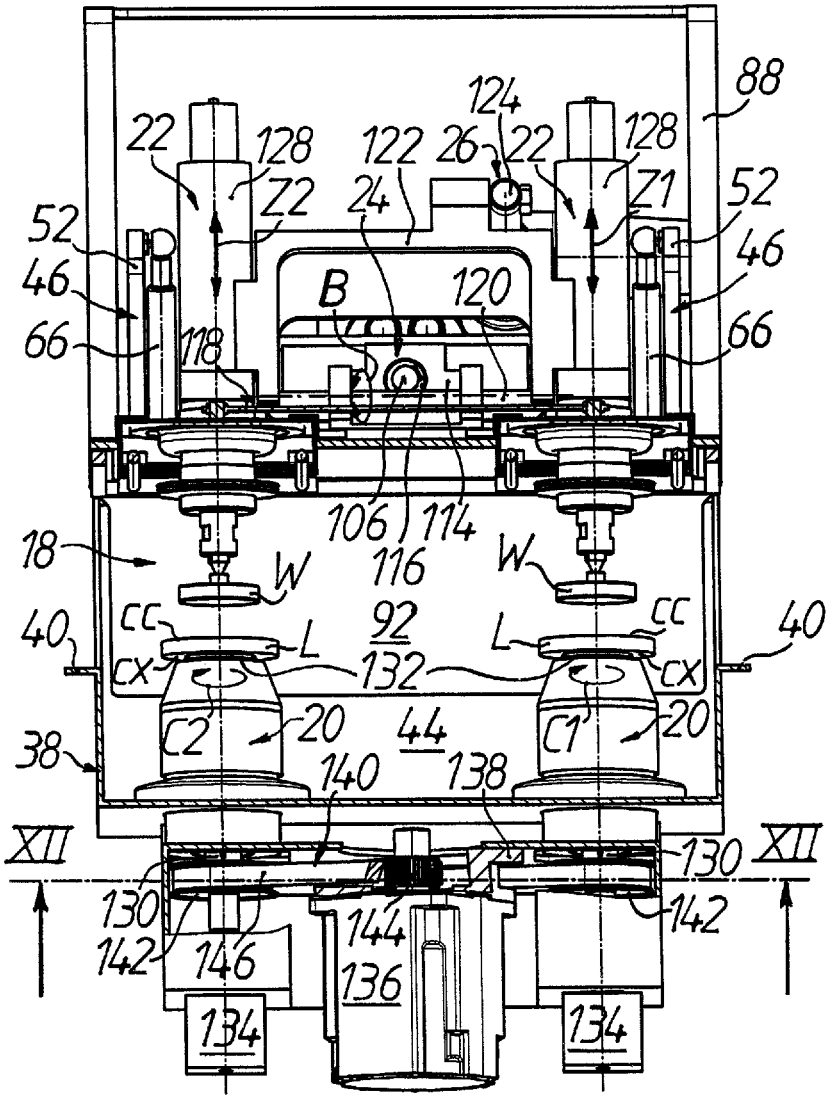
FIG. 10 shows a partly broken-away front view of the polishing machine according to FIG. 1 in the scale of FIGS. 6 and 7 and with the illustration simplifications thereof.
Figure 11:
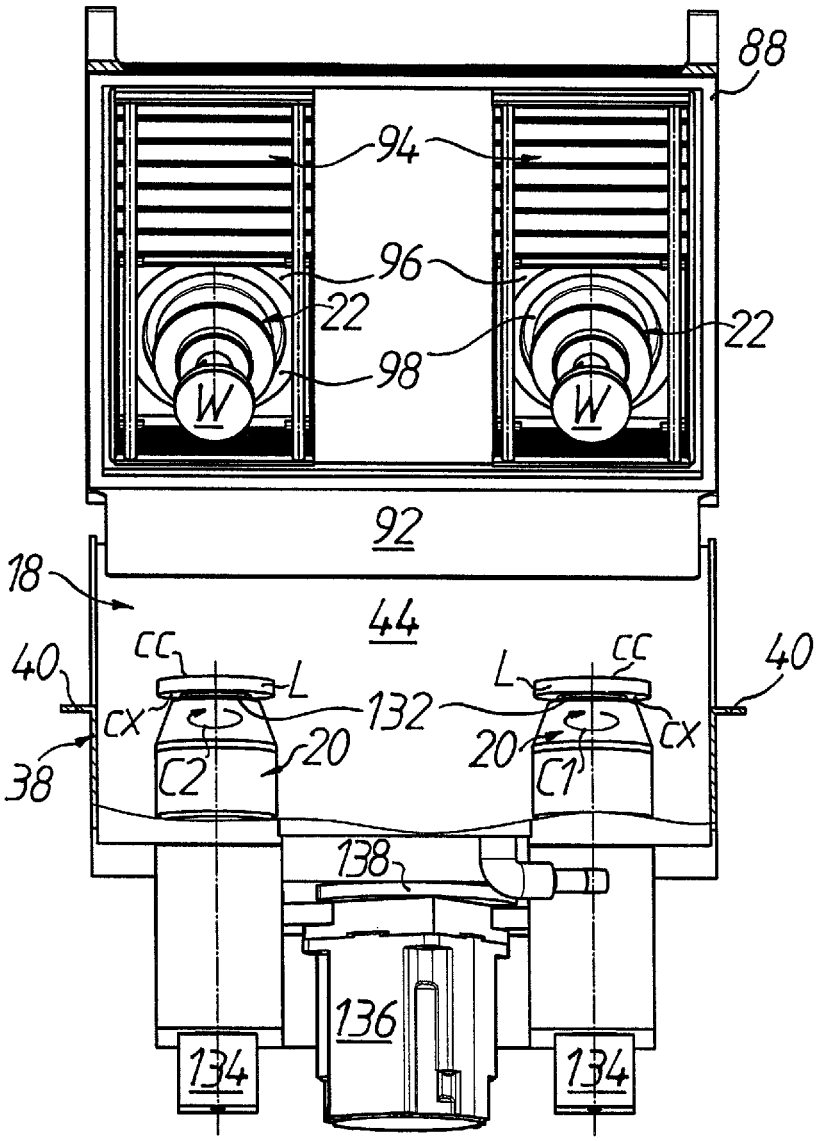
FIG. 11 shows a partly broken-away front view of the polishing machine according to FIG. 1 similarly to FIG. 10, in which the upper part of the machine is disposed in a position pivoted away from the lower part of the machine.
Figure 12:
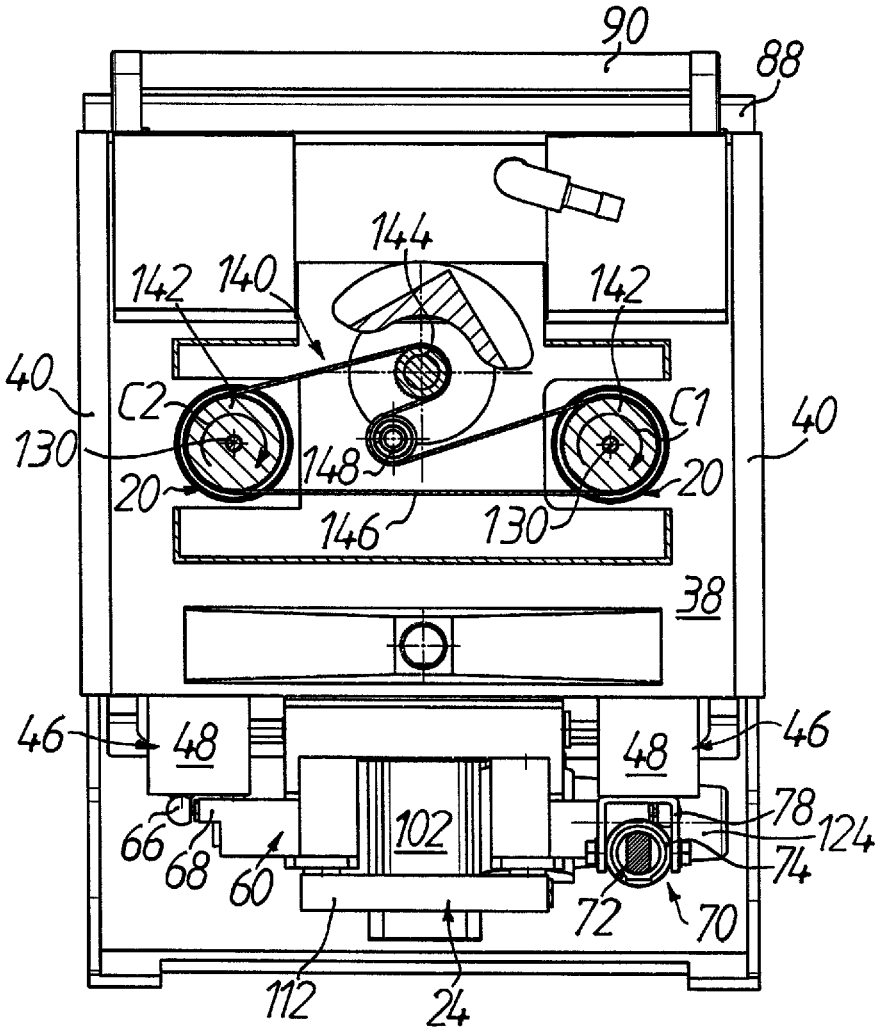
FIG. 12 shows a sectional view of the polishing machine according to FIG. 1 in correspondence with the section line XII-XII in FIG. 10, but tipped through 5° in the drawing plane so as to provide a frontal view of the drive mechanism (belt drive) for the workpieces.

As can be readily seen in, in particular, FIGS. 10 to 12 the workpiece spindles 20 are flange-mounted in the working space 18 from above on the base body 38 and each extend therethrough by a drive shaft 130 and an actuating mechanism for a collet chuck 132, by way of which a spectacle lens L blocked on a block member (not shown in more detail) can be clamped to the respective workpiece spindle to be axially fixed and capable of rotational entrainment. Of the actuating mechanism there can be seen in the figures primarily pneumatic cylinders 134 which serve the purpose of opening and closing the collet chucks 132 in a manner known per se.

Moreover, below the base body 38, i.e. outside the working space 18, a rotary drive 136—in the illustrated embodiment a speed-regulated asynchronous three-phase motor—is flange-mounted by a motor flange 138. The workpiece spindles 20 projecting into the working space 18 are drivable in common by the rotary drive 136 via a belt drive 140 to rotate at predetermined rotational speed about the workpiece axes C1, C2 of rotation. In that case, the belt drive 140 has, according to FIGS. 6, 7 and particularly 10 and 12, apart from belt pulleys 142 at the workpiece spindles 20 a belt pulley or belt pinion 144 driven by the rotary drive 136, a belt 146, which in the illustrated embodiment is a cogged belt, and a tensioning and return pulley 148 for the belt 146. The tensioning and return pulley 148 is seated between the workpiece spindles 20 and is mounted on the rotary drive 136, more precisely the motor flange 138, eccentrically with respect to the belt pulley 144 so that the belt 146 can be tensioned by a pivoting motion of the rotary drive 136 about its axis of rotation. The rotary drive 136 itself is in that case screw-connected with the base body 38 with the assistance of screws (and optionally nuts; neither shown), which extend through curved slots (similarly not illustrated), which are formed in the motor flange 138 or in the base body 38 and which allow a pivoting motion of the rotary drive 136 for tensioning of the belt 146 prior to tightening the screw connection.

As a result, the afore described polishing machine 14 makes possible, for example, the following procedure, which shall be described only for one spectacle lens L, since the second spectacle lens L of the respective "RX job" is processed by polishing in analogous manner and at the same time. After equipping the polishing machine 14 with the polishing tools W and the spectacle lenses L to be processed, for which purpose the upper part of the polishing machine 14 was pivoted up about the pivot axis 30 and then pivoted down again so as to facilitate access to the working space 18, initially by way of the pivot drive unit 26 the angle of incidence of the feed devices 32 and thus of the polishing tools W with respect to the workpiece axes C1, C2 of rotation is set to a predetermined value in dependence on the geometry, which is to be processed, of the spectacle lens L (pivot adjusting axis B). This angle of incidence is not changed during the actual polishing process in the case of the "tangential kinematics" already explained in the introduction (alternatively thereto the angle of incidence could, however, also be dynamically changed in the sense of "radial kinematics"). The polishing tool W is then moved by the oscillatory drive unit 24 into a position in which it is opposite the spectacle lens L (oscillation axis X). The polishing tool W is thereupon axially lowered by the feed device 22 in direction onto the spectacle lens L until it comes into contact therewith (linear movement Z1, Z2). The polishing-medium feed is now switched on and the spectacle lens L is set into rotation by the electric rotary drive 136 (C1, C2), in which case it entrains the contacting polishing tool W. The polishing tool W is then moved in oscillation with a relative small stroke over the spectacle lens L by the oscillatory drive unit 24 (oscillation axis X) so that the polishing tool W is guided over different surface regions of the spectacle lens L. In that case, the polishing tool W also moves slightly back and forth (linear movement Z1, Z2) following the (non-circular) geometry of the polished spectacle lens L. Finally, the polishing tool W is lifted off the spectacle lens L (linear movement Z1, Z2) by the feed device 22 after the polishing medium feed was switched off and the rotational movement of the spectacle lens stopped (workpiece axes C1, C2 of rotation). Lastly, the polishing tool W is moved by the oscillatory drive unit 24 into a rearward parked position (oscillation axis X), whereupon the upper part of the polishing machine 14 is pivoted up about the pivot axis 30 (pivot movement S) and the spectacle lens L can be easily removed from the polishing machine 14. The closing or holding function undertaken by the positioning and closing mechanism 70, more precisely the pneumatic cylinder 72 thereof, can moreover be safeguarded by a safety limit switch (not shown) which ensures that the polishing process can be started only when the machine upper part is closed, i.e. pivoted down.

Figure 15:
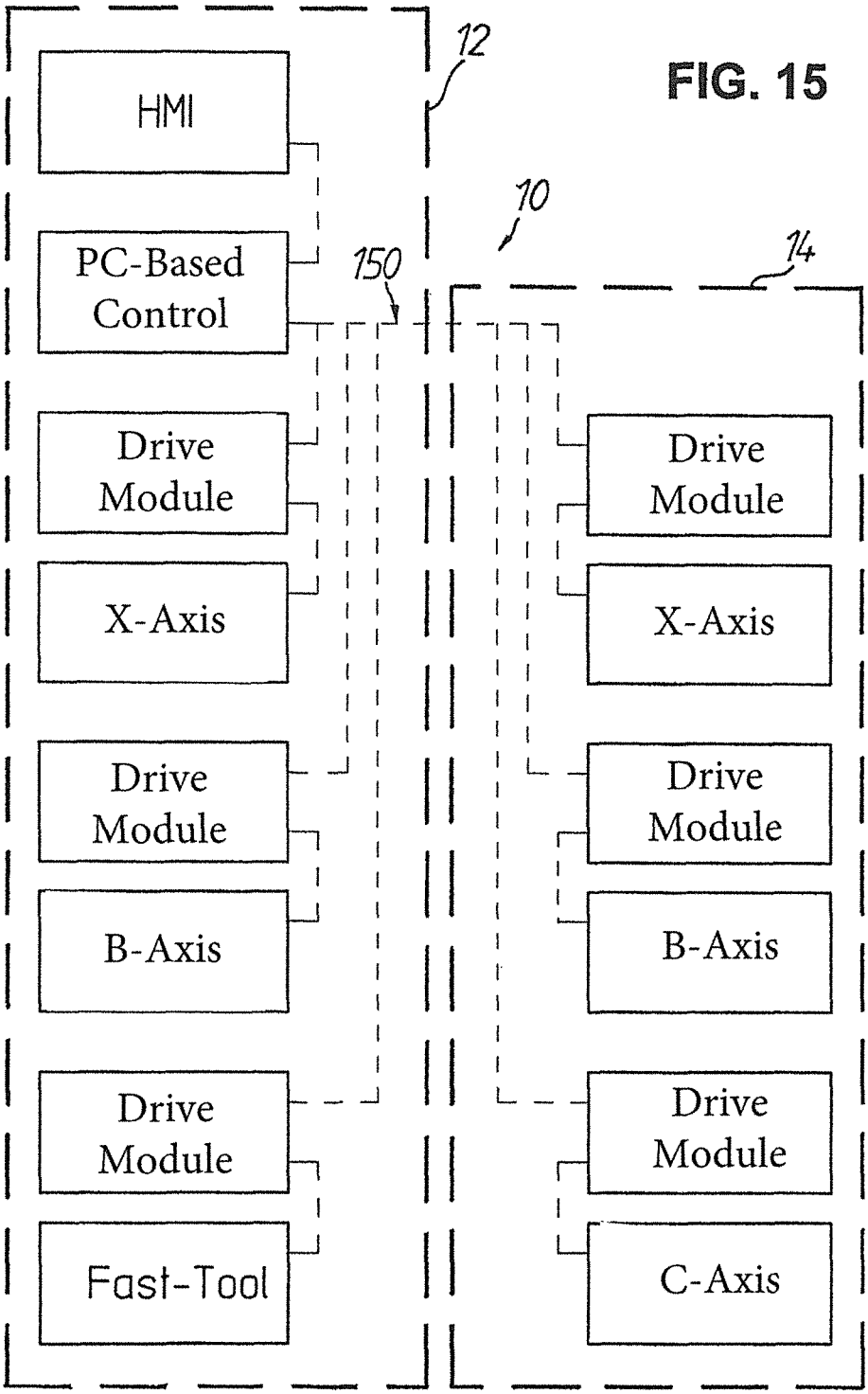
FIG. 15 shows a simplified block diagram of the CNC architecture of the flexible production cell according to FIG. 1.

Finally, a particularly economic control architecture of the flexible production cell 10 according to FIG. 1 is illustrated schematically in FIG. 15. According to that, the polishing machine 14 is connected by way of electrical connections 150 (for example, a bus system) as a module with the generator 12. However, in that regard only the generator 12 has equipment for man/machine communication HMI and a CNC control, in the illustrated embodiment in the form of a PC-based control, which controls the drive modules (servo-amplifier/converter) not only of the generator 12, but also of the polishing machine 14. In simple terms, the polishing machine 14 here does not have individual "intelligence", but only the electrical components required for generating the actual travel commands for the regulated or controlled axes, i.e. the positionally controlled oscillation axis X of the oscillatory drive unit 24 for the polishing tools W (in abbreviation: X axis), the pivot adjusting axis B of the pivot drive unit 26 for the polishing tools W (in abbreviation: B axis) and the speed-regulated axes C1, C2 of rotation of the workpiece spindles 20 holding the spectacle lenses L and driving them by way of the rotary drive 36 (in abbreviation: C axis).

A polishing machine for, in particular, spectacle lenses includes at least one workpiece spindle, which projects into a working space, for a rotary drive of the spectacle lens about a workpiece axis of rotation, at least one feed device for lowering and raising a polishing tool with respect to the spectacle lens, an oscillatory drive unit for reciprocating movement of the feed device in an oscillation direction, which during the polishing process extends substantially transversely to the workpiece axis of rotation, and a pivot drive unit for pivoting the feed device about a pivot adjusting axis, which extends substantially perpendicularly to the workpiece axis of rotation and substantially normal to the oscillation direction. In order to provide a very compact and ergonomically appropriate polishing machine a pivot mechanism is provided by which the feed device, the oscillatory drive unit and the pivot drive unit are movable relative to the workpiece spindle away from a closed relative position, under opening of the working space, to an open relative position and vice versa.

Variations and modifications are possible without departing from the scope and spirit of the present invention as defined by the appended claims.

The invention claimed is:

1. A device for the finish-processing of optically effective surfaces of, in particular, spectacle lenses as workpieces, comprising:

a pivot mechanism having a pivot frame pivotably mounted to provide a closed operating position, in which a working space located below the pivot frame creates a cavity for processing the workpieces and an open access position; in which the cavity is open to provide access to the workpieces, at least one workpiece spindle, which projects into the working space and by way of which a workpiece to be processed is drivable to rotate about a workpiece axis of rotation, at least one feed device for a tool, by which the tool is movable towards the workpiece and away therefrom, an oscillatory drive unit, by which the feed device is reciprocatingly movable in a direction of oscillation which when processing takes place extends substantially transversely to the workpiece axis of rotation, a pivot drive unit, by which the feed device is pivotable about a pivot adjusting axis extending substantially perpendicularly to the workpiece axis of rotation and substantially normal to the direction of oscillation, and wherein the feed device, the oscillatory drive unit, and the pivot drive unit are all mounted to the pivot frame which collectively pivots the feed device, the oscillatory drive unit and the pivot drive unit relative to the workpiece spindle between the closed operating position and the open access position.

2. A device according to claim 1, characterized in that the pivot mechanism has for the feed device, the oscillatory drive unit and the pivot drive unit a common pivot axis about which the feed device, the oscillatory drive unit and the pivot drive unit are pivotable away in common with respect to the workpiece spindle and conversely.

3. A device according to claim 2, characterized in that the pivot axis lies behind the working space as seen from an operator position.

4. A device according to claim 3, characterized in that the pivot axis extends substantially in parallel to the pivot adjusting axis.

5. A device according to claim 4, characterized in that the pivot frame has a grip section, via which the feed device, the oscillatory drive unit and the pivot drive unit are manually pivotable away with respect to the workpiece spindle and conversely.

6. A device according to claim 5, characterized in that the pivot frame carries a hood for opening and closing the device.

7. A device according to claim 6, characterized in that the pivot mechanism comprises at least one spring element, which facilitates a pivoting motion away of the feed device, the oscillatory drive unit and the pivot drive unit with respect to the workpiece spindle.

8. A device according to claim 7, characterized by a positioning and closing mechanism which during the processing holds the feed device, the oscillatory drive unit and the pivot drive unit in their closed position and ensures a substantially perpendicular alignment of the linearly extending oscillation direction with respect to the workpiece axis of rotation.

9. A device according to claim 8, characterized in that the positioning and closing mechanism comprises a pressure-medium cylinder for holding the feed device, the oscillatory drive unit and the pivot drive unit in their closed position.

10. A device according to claim 9, characterized in that the positioning and closing mechanism comprises at least one adjustable abutment, which optionally comprises a shock absorber and by which the orientation of the oscillation direction with respect to the workpiece axis of rotation is adjustable.

11. A device according to claim 10, characterized by a base body, which bounds the working space and supports the workpiece spindle and to which two mounts supporting the pivot axis are fastened, wherein the oscillatory drive unit comprises a guide block pivotably mounted on the pivot axis between the mounts.

12. A device according to claim 11, characterized in that the oscillatory drive unit comprises two guide rods, that are longitudinally displaceably supported in the guide block, a guide head and a guide plate, wherein the guide rods are connected together on one side of the guide block by way of the guide head, whereas they are connected together on the other side of the guide block by way of the guide plate, and wherein the guide head is displaceable relative to the guide block by a threaded drive.

13. A device according to claim 12, characterized in that the pivot drive unit has a pivot yoke, which carries the feed device and which is pivotably supported on the guide head of the oscillatory drive unit, wherein arranged between the guide plate of the oscillatory drive unit and the pivot yoke is a stroke module by which the pivot yoke is pivotable about the pivot adjusting axis.

14. A device according to claim 13, characterized by two workpiece spindles, which project into the working space and which are drivable for rotation about the workpiece axes of rotation by way of a belt drive comprising a belt pulley rotatable by a rotary drive, a belt and a tensioning and return pulley for the belt, which is seated between the workpiece spindles and mounted on the rotary drive eccentrically with respect to the belt pulley so that the belt is tensionable by a pivoting motion of the rotary drive.

15. A device according to claim 2, characterized in that the pivot axis extends substantially in parallel to the pivot adjusting axis.

16. A device according to claim 2, characterized by a base body, which bounds the working space and supports the workpiece spindle and to which two mounts supporting the pivot axis are fastened, wherein the oscillatory drive unit comprises a guide block pivotably mounted on the pivot axis between the mounts.

17. A device according to claim 1, characterized in that the pivot mechanism has a pivot frame with a grip section, via which the feed device, the oscillatory drive unit and the pivot drive unit are manually pivotable away with respect to the workpiece spindle and conversely.

18. A device according to claim 17, characterized in that the pivot frame carries a hood for opening and closing the device.

19. A device according to claim 1, characterized in that the pivot mechanism comprises at least one spring element, which facilitates a pivoting motion away of the feed device, the oscillatory drive unit and the pivot drive unitwith respect to the workpiece spindle.

20. A device according to claim 1, characterized by a positioning and closing mechanism which during the processing holds the feed device, the oscillatory drive unit and the pivot drive unit in their closed position and ensures a substantially perpendicular alignment of the linearly extending oscillation direction with respect to the workpiece axis of rotation.

21. A device according to claim 20, characterized in that the positioning and closing mechanism comprises a pressure-medium cylinder for holding the feed device, the oscillatory drive unit and the pivot drive unit in their closed position.

22. A device according to claim 20, characterized in that the positioning and closing mechanism comprises at least one adjustable abutment, which optionally comprises a shock absorber and by which the orientation of the oscillation direction with respect to the workpiece axis of rotation is adjustable.

23. A device according to claim 1, characterized by two workpiece spindles, which project into the working space and which are drivable for rotation about the workpiece axes of rotation by way of a belt drive comprising a belt pulley rotatable by a rotary drive, a belt and a tensioning and return pulley for the belt, which is seated between the workpiece spindles and mounted on the rotary drive eccentrically with respect to the belt pulley so that the belt is tensionable by a pivoting motion of the rotary drive.

24. A flexible production cell for the preliminary-processing and finish-processing of spectacle lenses, comprising:

a device for the preliminary-processing of optically effective surfaces of the spectacle lenses by milling, turning and/or grinding, which comprises regulated or controlled drive axes for workpiece and/or tool, with respectively associated drive module, a device for the finish-processing of the optically effective surfaces of the spectacle lenses by polishing comprising:

a pivot mechanism having a pivot frame pivotably mounted to provide a closed operating position, in which a working space located below the pivot frame creates a cavity for processing the workpieces and an open access position; in which the cavity is open to provide access to the workpieces, at least one workpiece spindle, which projects into the working space and by way of which a workpiece to be processed is drivable to rotate about a workpiece axis of rotation, at least one feed device for a tool, by which the tool is movable towards the workpiece and away therefrom, an oscillatory drive unit, by which the feed device is reciprocatingly movable in a direction of oscillation which when processing takes place extends substantially transversely to the workpiece axis of rotation, a pivot drive unit, by which the feed device is pivotable about a pivot adjusting axis extending substantially perpendicularly to the workpiece axis of rotation and substantially normal to the direction of oscillation, wherein the feed device, the oscillatory drive unit, and the pivot drive unit are all mounted to the pivot frame which collectively pivots the feed device, the oscillatory drive unit and the pivot drive unit relative to the workpiece spindle between the closed operating position and the open access position, which comprises regulated or controlled drive axes for workpiece and/or tool, with respectively associated drive modules, and which is coupled as a module to the device for the preliminary-processing, and wherein only the device for the preliminary-processing has equipment for man/machine communication (HMI) and a CNC control, which controls the drive modules of both devices.

* * * * *